United States Patent [19]

de Nevers

[11] 4,182,400

[45] Jan. 8, 1980

[54] COUNTERCURRENT HEAT TRANSFER APPARATUS AND METHOD

[75] Inventor: Noel H. de Nevers, Salt Lake City, Utah

[73] Assignee: Oros Company, Salt Lake City, Utah

[21] Appl. No.: 943,057

[22] Filed: Sep. 18, 1978

[51] Int. Cl.[2] ..... F28C 3/10

[52] U.S. Cl. ..... 165/1; 165/84; 165/86; 165/111; 165/120; 209/362

[58] Field of Search ..... 165/84, 86, 88, 1, 94, 165/111, 120; 432/214, 215; 209/238, 362

[56] References Cited

U.S. PATENT DOCUMENTS

| | | | |
|---|---|---|---|
| 892,502 | 7/1908 | Coon | 209/238 |
| 1,085,528 | 1/1914 | Bighetti | 209/362 |
| 3,253,892 | 5/1966 | Brignac et al. | 165/120 |

FOREIGN PATENT DOCUMENTS

| | | | |
|---|---|---|---|
| 738732 | 11/1970 | Belgium | 165/111 |
| 1079438 | 8/1967 | United Kingdom | 165/111 |
| 1203286 | 2/1970 | United Kingdom | 165/111 |

*Primary Examiner*—Sheldon Jay Richter
*Attorney, Agent, or Firm*—Calvin E. Thorpe

[57] ABSTRACT

Apparatus for transferring heat between solid particles includes an inclined cylindrical drum in which is disposed a helical auger. The outer lip of the auger, which is maintained in contact with the interior wall of the drum, is curved in the upward direction of the incline axis. The auger blade includes a plurality of apertures of generally uniform size. A feed bin is provided to introduce a first granular material into the upper end of the drum, with the particles of such granular material generally being of a size less than the size of the apertures in the auger blade. A second feed bin is provided to introduce a second granular material into the lower end of the drum, with the particle size of the second granular material generally being greater than the size of the apertures. The drum and auger are rotatable about the incline axis. When rotated, the first granular material sifts through the apertures in the auger blade downwardly in the drum, while the second granular material is forced upwardly by the auger blade. In this manner the first and second materials are placed in contact with one another. Provision of a curved outer lip for the auger facilitates downward movement of the first granular material since the material can move downwardly through the apertures in more nearly a vertical direction. This, in turn, facilitates better counterflow of the first and second granular materials to achieve heat exchange therebetween.

8 Claims, 3 Drawing Figures

COUNTERCURRENT HEAT TRANSFER APPARATUS AND METHOD

BACKGROUND OF THE INVENTION

This invention relates to a method and apparatus for counterflow heat exchange between solids in which the solids are brought into contact with one another to facilitate the heat exchange.

A common and recurring industrial need is that of transferring heat to or removing heat from materials for the purpose of, for example, preparing such materials for processing operations which are to be carried out at certain temperatures. After the processing, it is oftentimes desirable to bring the temperature of the material back to its previous temperature for storage, packaging, etc.

Heat transfer or exchange between fluids is oftentimes accomplished by the well known process of placing two fluids of differing temperature in as close proximity as possible with each other. One of the simplest ways of doing this is to place a small pipe inside a larger pipe and then apply one fluid to the small pipe and the other fluid to the larger pipe (outside the smaller pipe). If the two fluids are applied to the pipe so that they both flow in the same direction (parallel flow), then the temperatures of the two fluids tend toward the average therebetween. If the fluids are applied to the pipes to flow in opposite directions (counterflow), then the temperature of each fluid tends toward the other fluid's entering temperature.

There have been a number of suggestions for providing a heat exchange between solid materials including those disclosed in U.S. Pat. Nos. 2,592,783 and 4,038,021. In the first mentioned patent, heated or cooled balls are brought into direct contact with a material to be either heated or cooled inside a rotating drum. The balls are piled up in one end of the rotating drum and the material in the other end and the rotation of the drum tends to move the balls and material towards one another in a type of counterflow operation to somehow mix so that heat can be exchanged between the balls and the material.

The structure disclosed in the latter mentioned patent includes an inclined tubular casing and an auger disposed with the casing, with the flights of the auger being perforated. A granular product to be dried and heat conducting particles such as salt, are discharged into the casing from an opening in the bottom end of a tubular shaft of the auger. As the auger is rotated, the granular product and heat conducting particles are in some manner intermixed, with the granular product being forced upwardly in the casing since the product is of a size too large to pass through the holes in the auger flights, and the heat conducting particles apparently staying near the bottom of the casing since the particles are small enough to pass through the holes in the auger flights. This arrangement, of course, does not provide for a counterflow operation but rather provides for a type of mixing of two different size particles and then the removal of one size from the mixture.

SUMMARY OF THE INVENTION

It is an object of the present invention to provide a new and improved method and apparatus for enabling exchange of heat between solids.

It is another object of the invention to provide an efficient apparatus and method for enabling exchange of heat between solid particles in a type of counterflow operation.

It is a further object of the invention to provide such a method and apparatus in which effective use of gravity is utilized to facilitate the counterflow operation.

The above and other objects of the invention are realized in a specific illustrative embodiment thereof which includes a generally tubular member mounted so that its longitudinal axis is inclined, and a helical auger disposed within the tubular member so that its longitudinal axis is generally coincident with the axis of the tubular member, the flights of the auger having perforations therein, and the outer portions or lips of the flights of the auger being formed to curve upwardly in the direction of the incline of the tubular member. Thus, the flights of the auger, rather than being generally flat as with prior art augers, have outer lips which are formed to curve in one direction along the longitudinal axis of the auger. Also included is a bin or other guide structure for introducing a first granular material into the upper end of the tubular member, another guide structure for introducing a second granular material into the lower end of the tubular member, and apparatus for causing the auger to rotate. The first granular material is of a size generally smaller than the perforations in the auger flights whereas the second granular material is of a size generally larger than the size of the perforations. When the auger is rotated, the auger flights force the second granular material upwardly in the tubular member, while the first granular material is agitated to sift through the perforations in the auger flights and move downwardly in the tubular member. In this manner, the first and second granular materials are placed in contact with each other to allow a heat exchange to occur between the materials. The sifting of the first material is facilitated by the curvature of the auger flights since the outer lip thereof at its lowermost point of excursion may be nearly horizontal and thus the first granular material tends to move vertically downwardly through the perforations. Gravity can thus more effectively operate on the material to cause it to sift through the perforations.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
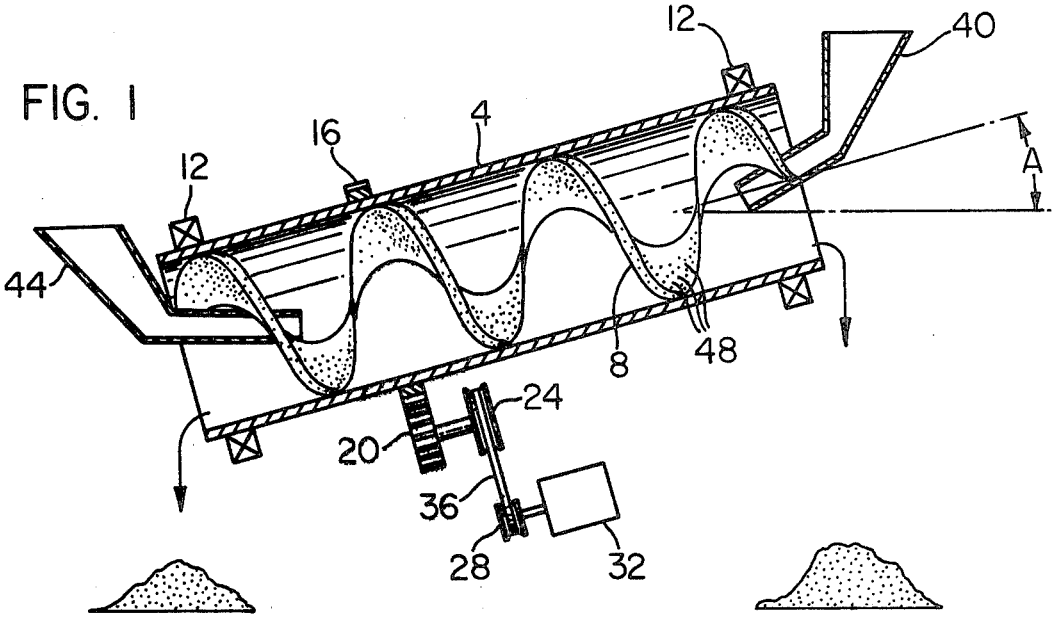
FIG. 1 is a side elevational, partially cross-sectional view of counterflow heat exchange apparatus made in accordance with the present invention.

Referring to the drawings, there is shown a hollow drum or tube 4 inclined a certain angle A with respect to the horizontal. The drum 4 is open at either end thereof as indicated in the drawing.

Disposed in the drum is a helical auger 8 which extends from one end of the drum to the other end thereof. The auger blade or flights contact the interior wall of the drum 4 at locations which define a helix on the drum wall. In the embodiment shown in FIG. 1, the outer edge of the auger flights is in contact with and secured to the interior wall of the drum 4. An alternative arrangement could be provided in which the auger 8 were mounted on a shaft which would extend longitudinally within the auger so that the auger flights circumscribed the shaft. With this arrangement, the outer lip of the auger may or may not be in contact with the drum 4.

The drum 4 is mounted to rotate within bearings 12 which could be affixed to a variety of well known support structures. Circumferentially mounted on the exterior wall of the drum 4 is a driven gear wheel 16. A drive gear wheel 20 is placed in driving contact with the gear 16 as shown and a pulley 24 is axially coupled to the drive gear wheel. Another pulley 28 is mounted on the drive shaft of a motor 32 and the pulleys 24 and 28 are coupled together by a belt 36. Operation of the motor 32 causes rotation of the pulley 28 which, in turn, causes rotation of the pulley 24. When the pulley 24 is rotated, the drive gear 20 is rotated to drive the driven gear wheel 16 to thereby cause the drum 4 to rotate. It should be understood that a variety of arrangements could be provided for causing rotation of the drum 4 and the particular arrangement shown in FIG. 1 is only for purposes of illustration.

Mounted at the upper end of the drum 4, but out of contact therewith, is a feed bin 40. The lower end of the bin 40 extends into the upper opening of the drum 4 so that material fed into the bin 40 will flow into the upper end of the drum. As will be explained momentarily, a first granular material will be fed through the bin 40 into the drum 4.

Another bin 44 is positioned near the lower end of the drum 4 to feed another granular material into the drum. The lower end of the bin 44 extends into the lower end of the drum 4 within the auger 8. Thus, a second granular material supplied to the bin 44 will be deposited at a location where the auger flights will contact the material before it can flow out of the drum.

The auger flights include perforations or openings 48 which are generally of a certain uniform size. The perforations are provided to allow sifting therethrough of the first granular material introduced through the bin 40 into the drum 4. To accomplish this, the size of the perforation must be greater than the size of the first granular material.

Figure 2:
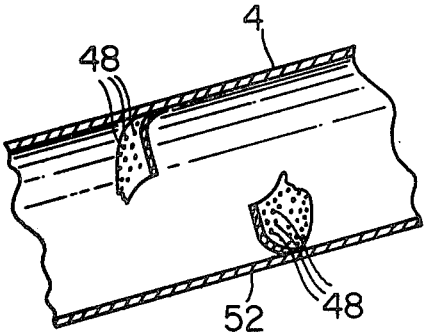
FIG. 2 is a cross-sectional view showing the structure of the auger of FIG. 1.

As best seen in FIG. 2, the outer lip 52 of the auger is curved toward the upper end of the drum 4. With this curvature, the outer portion or lip 52 of the auger is disposed generally horizontally at its lowermost excursion within the drum 4. In other words, the openings in that portion of the auger nearest the interior wall of the drum 4 extend in generally a vertical direction. With this configuration, material introduced through the bin 40 into the drum are more likely to sift or flow through the openings toward the lower end of the drum. This is because gravity tends to pull the granular material vertically downwardly and since the openings are oriented in the vertical direction, there is a greater chance that the material will fall through the openings.

In operation, a first granular material having a certain temperature and having particles of a size generally smaller than the size of the perforations 48 is introduced into the bin 40 and thus into the drum 4. A second granular material having a temperature different from the temperature of the first granular material and having particles of a size generally larger than the size of the perforations 48 is introduced into the bin 44 and thus into the drum 4. The drum is then rotated so that the flights of the auger 8 appear to move toward the upper end of the drum and this results in the auger pushing the second granular material upwardly since the material is too large to sift through the perforations. As the drum and auger are rotated, the first granular material, since its particles are smaller than the size of the perforations in the auger, tends to sift through the perforations to move generally downwardly in the drum 4. Eventually the first and second granular materials come in contact with one another and then moves past each other in a counterflow operation as the first material moves downwardly and the second material moves upwardly. Since the materials are then repeatedly in contact, exchange of heat takes place between the materials. The first material ultimately filters through the auger perforations and out the lower end of the drum whereas the second material is forced upwardly and out the upper end of the drum.

To facilitate mixing of the two materials, vibration apparatus could be attached to the drum 4 to cause the drum to vibrate in either the axial or radial direction (or a combination of the two). Such vibratory action would tend to cause the smaller first granular material to sift through the openings in the auger.

Figure 3:
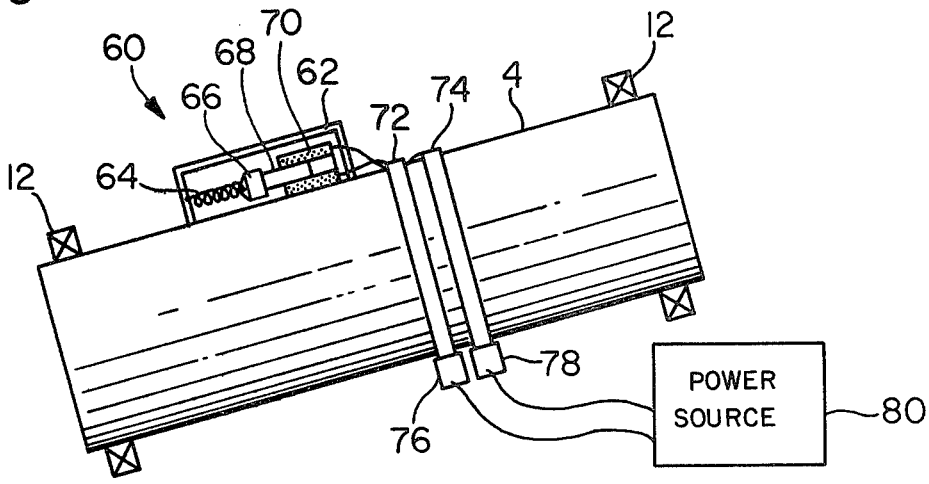
FIG. 3 is a side elevational view of the apparatus with a cross-sectional view of a vibrator mounted on the apparatus.

An exemplary arrangement for causing the drum 4 to vibrate is shown in FIG. 3. This arrangement includes a vibrator 60 (shown in cross-section) mounted on the exterior of the drum 4. The vibrator 60 is conventional and might consist of a casing 62 in which is housed a coil spring 64, one end of which is attached to an end wall of the casing 62 and the other end of which is attached to a weight 66. The weight is attached to a core element 68 of a solenoid 70 located at the other end of the casing. The solenoid is electrically connected to two slip rings 72 and 74 which circumscribe the drum 4. Stationary brushes 76 and 78 are positioned to make electrical contact with the rings 72 and 74 respectively as the drum 4 is rotated. The brushes 76 and 78 are coupled to a power source 80.

In operation, power is intermittently supplied by the power source 80 to the brushes 76 and 78 and thence to the rings 72 and 74 and the solenoid 70. This causes the alternate activation and deactivation of the solenoid 70 so that the solenoid alternately attracts and releases the core element 68 and thus the weight 66. This, in turn, results in oscillation of the weight 66 in a line generally parallel with the axis of the drum 4, and thus vibration of the drum 4. The vibrator 60 is a conventional device.

It should be understood that other arrangements for imparting vibration to the drum 40 could be provided including imparting vibration to the bearings 12 or to the drive gear 20.

Although the auger 8 has been discussed in terms of being constructed of a solid material having openings formed therein, it should be understood that the auger could be made of a screen mesh material in which the openings in the screen were of a generally uniform size. Additionally, although various angles of incline A could be employed depending upon the kinds of material to be mixed, it has been found that an angle of between 1 degree and 15 degrees is generally advantageous for optimizing the mixing of the materials for most sizes of materials.

It is to be understood that the above-described arrangements only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A method of transferring heat from one granular material to another comprising introducing into one end of a generally cylindrical drum a first granular material composed of particles of generally a first size and being of a certain temperature, said drum being positioned so that its cylindrical axis is inclined with said one end of the drum being higher than the other end, a helical auger being disposed in said drum, the flights of said auger including a plurality of apertures having a size which is larger than said first size, the outer lip of said flights being curved toward said one end of the drum, introducing into said other end of the drum a second granular material composed of particles generally of a second size and being of a temperature different from said certain temperature, said second size being larger than the size of said apertures, and rotating said auger to move said second granular material upwardly toward said one end of the drum, and to enable sifting downwardly of said second granular material through the apertures in said flights toward said other end of the drum, the first and second granular materials thereby contacting one another to allow transfer of heat therebetween.

2. Apparatus for counterflow heat exchange between first and second granular materials comprising a generally tubular member mounted so that the longitudinal axis thereof is inclined, a helical auger disposed within said tubular member so that its longitudinal axis is generally coincident with the axis of said tubular member, the flights of said auger having perforations of a size generally larger than the particles of said first granular material and generally smaller than the particles of said second granular material, the outer portion of said flights being formed to extend near the interior wall of said tubular member and to curve in the direction of the incline upwardly, means for introducing the first granular material into the upper end of said tubular member, means for introducing the second granular material into the lower end of said tubular member, and means for causing said auger to rotate so that the auger flights force the second granular material upwardly in the tubular member and so that the first granular material sifts through the perforations in the flights of the auger to move downwardly in the tubular member.

3. Apparatus as in claim 2 wherein the outer portion of said flights is curved so that the first granular material tends to sift vertically downwardly through the perforations in the flights.

4. Apparatus as in claim 2 further including means for causing said auger to vibrate.

5. Counterflow heat exchange apparatus for solids comprising a generally cylindrical drum rotatable about the cylindrical axis thereof, said drum being oriented so that said axis is positioned at an angle with respect to the horizontal, helical blade means mounted within said drum to rotate as said drum is rotated, the outer lip of said blade means being in contact with the interior wall of said drum, said contact points defining a helix on the interior wall of the drum, said outer lip being curved toward the upper end of said drum, a plurality of apertures being formed in said blade means in the outer lip thereof, means for introducing into the upper end of said drum a first granular material whose particles are generally of the size to enable passage through said apertures, means for introducing into the lower end of said drum a second granular material whose particles are generally of a size which would not enable passage through said apertures, and means for rotating said drum so that said blade means is rotated to move said second material toward and out the upper end of said drum and to allow movement of said first material toward and out the lower end of said drum.

6. Apparatus as in claim 5 wherein said drum is oriented so that said axis is positioned at an angle of from 1 degree to 15 degrees with respect to the horizontal.

7. Apparatus as in claim 5 wherein the cross-sectional profile of the outer lip of said helical blade means at its lowest most excursion is generally disposed horizontally.

8. Apparatus as in claim 5 further comprising means for causing said drum to vibrate to thereby agitate the granular materials and facilitate the passage of said first granular material through said apertures.

* * * * *